US005944078A

United States Patent [19]

Lindholm

[11] Patent Number: 5,944,078

[45] Date of Patent: Aug. 31, 1999

[54] FEEDING ROLLER FOR A LOG FEEDING DEVICE OF A DEBARKING MACHINE

[75] Inventor: Holger Lindholm, Lohja, Finland

[73] Assignee: Valon Kone Oy, Lohja, Finland

[21] Appl. No.: 08/983,126

[22] PCT Filed: Jul. 25, 1996

[86] PCT No.: PCT/FI96/00422

§ 371 Date: Jan. 6, 1998

§ 102(e) Date: Jan. 6, 1998

[87] PCT Pub. No.: WO97/04930

PCT Pub. Date: Feb. 13, 1997

[30] Foreign Application Priority Data

Jul. 28, 1995 [FI] Finland ..... 953631

[51] Int. Cl.[6] ..... B27C 1/12; B27B 31/00

[52] U.S. Cl. ..... 144/248.5; 144/208.1; 144/246.1; 144/248.7; 198/624

[58] Field of Search ..... 144/208.1, 208.4, 144/208.8, 242.1, 246.1, 248, 248.4, 248.5, 248.7, 250.1; 198/624, 780, 785, 842, 834, 835; 492/38, 48

[56] References Cited

U.S. PATENT DOCUMENTS

| | | | |
|---|---|---|---|
| 2,588,121 | 3/1952 | Johnston . | |
| 4,431,039 | 2/1984 | Barwise et al. | 144/248.7 |
| 4,509,574 | 4/1985 | Gaitten | 144/248.5 |
| 4,721,139 | 1/1988 | Peterson et al. | 144/248.7 |
| 4,972,890 | 11/1990 | Isley | 144/248.7 |
| 5,111,860 | 5/1992 | Wingate-Hill et al. | 144/248.4 |
| 5,797,438 | 8/1998 | Dye | 144/248.5 |

FOREIGN PATENT DOCUMENTS

| | | |
|---|---|---|
| 772847 | 9/1977 | Finland . |
| 500 141 | 9/1990 | Finland . |
| 54244 | 7/1978 | Sweden . |
| 444 653 | 4/1986 | Sweden . |
| WO 89/01855 | 3/1989 | WIPO . |
| WO 95/01856 | 1/1995 | WIPO . |

*Primary Examiner*—W. Donald Bray
*Attorney, Agent, or Firm*—Burns, Doane, Swecker & Mathis, L.L.P.

[57] ABSTRACT

A feeding roller for a log feeding device of a debarking machine, said feeding roller (1) comprising a substantially drum-like body (3) and a rib formation (5) consisting of ribs (9) provided in separate rib elements (6) to be fastened to the circumference of said body (3) for feeding and centring a log. To allow the feeding roller to be adapted for different tree species and different debarking conditions, separate replaceable sets of rib elements (6) are provided for the body of the feeding roller, the design (a–d, r) of the ribs being different in separate sets of rib elements for different tree species and debarking conditions.

6 Claims, 2 Drawing Sheets

Figure 1:
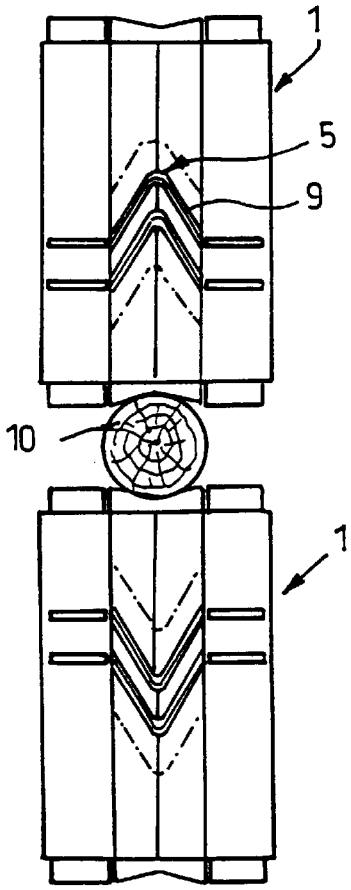

FIG. 3
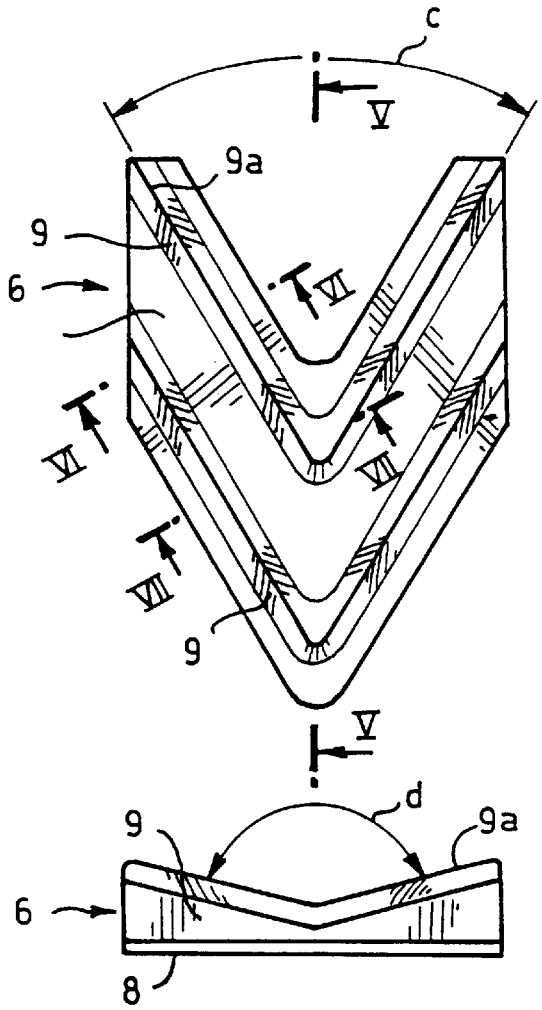
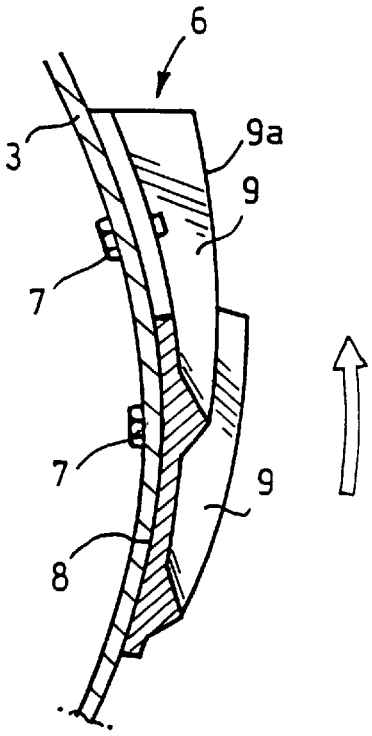
FIG. 5
FIG. 4
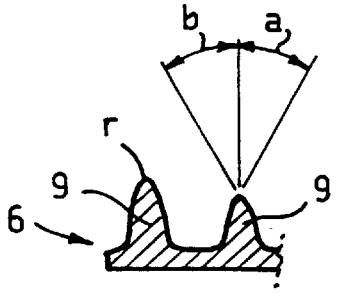
FIG. 6
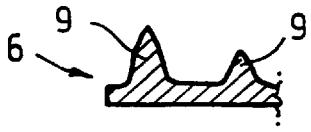
FIG. 7

FEEDING ROLLER FOR A LOG FEEDING DEVICE OF A DEBARKING MACHINE

The invention relates to feeding roller for a log feeding device of a debarking machine, said feeding roller comprising a substantially drum-like body and a rib formation consisting of ribs positioned at intervals on the circumference of said body, whereby the ribs are provided in separate rib elements to be secured to the body, and whereby a plurality of rib elements mounted one after the other around the circumference of the body provides said rib formation.

In debarking machines where the log to be debarked is centred according to the centre of a fixed rotor, the purpose of feeding devices is to provide the necessary force for feeding the log through the rotor, to centre the log in lateral and vertical direction on the rotation axis of the rotor, and to control the forces which are generated as a result of the debarking and which tend to rotate the log. The purpose of a feeding roller of a feeding device is thus to both feed and centre logs of various tree species under various conditions.

The feeding rollers previously used in rotor-type debarking machines have been spiked rollers, ribbed rollers and combinations thereof.

The known spiked roller constructions consist of two or more spiked feeding rollers comprising a cylindrical body and a sufficient number of conical spikes welded to the outer mantle surface of the body. The rollers are connected to each other by a lever mechanism which controls the movement of the rollers so that the log to be debarked is fed to the centre of the rotor.

The known ribbed roller constructions consist of two ribbed feeding rollers comprising either a cylindrical body to which wedge-shaped ribs are welded or a double-cone-shaped body to which ribs of equal height are welded. The double-cone shape of the rollers allows the log to be guided in lateral direction towards the centre of the rotor. The rollers are connected to each other by a lever mechanism which controls the movement of the rollers so that the log to be fed is guided in vertical direction towards the centre of the rotor.

In the known solutions, the feeding rollers on both sides of the rotor of a debarking machine are similar in construction, and the need for different gripping forces is attended to, for example, by adjusting the pressure in a hydraulic cylinder connected to the lever mechanism of the roller construction.

In addition, in the known solutions, identical feeding rollers are used for debarking different tree species and in different conditions, such as summer and winter debarking. The unequal feeding forces and anti-rotation forces required in different conditions are provided, for example, by adjusting the pressure in a hydraulic cylinder connected to the mechanism.

PCT publication WO 95/01856 discloses a construction in which separate slip-stops are mounted by chains successively on the circumference of a rubber drive wheel. The purpose of the slip-stops is to enhance the gripping of the drive wheel to the tree trunk to be transferred. The slip-stops are all identical in shape.

In rotor debarking, it is essential to the result how much the surface of the log to be debarked is damaged by the spiked or ribbed rollers of the feeding devices. In the known devices it is possible, in practice, to adjust only the pressure exerted by the rollers on the surface of the log; the surface of the log is therefore always damaged to some extent when identical rollers are used for different tree species and under different conditions. In practice, this drawback can be avoided to some extent by blunting or sharpening the fixed ribs. If such a method of adjustment is used, the rollers are naturally subjected to wear more than usual, which makes it necessary to change the rollers after a shorter period of use.

A further problem with the existing ribbed roller constructions where the ribs are made of plate profiles is that the gaps between the ribs are filled with bark and wood, which reduces the gripping force of the rollers, wherefore the use of unnecessarily high compression pressures is required.

The object of the present invention is to provide a feeding roller which avoids the above drawbacks and allows the ribs of the feeding roller to be adapted for various tree species and various debarking conditions in a simple manner with respect to the manufacture and use. This is achieved with a feeding roller of the invention, which is characterized in that separate replaceable sets of rib elements are provided for the body of the feeding roller, the design of the ribs being different in separate sets of rib elements for different tree species and debarking conditions.

The invention provides a feeding roller in which the ribs are provided in replaceable sets of rib elements, whereby the ribs can be replaced in a simple manner with ribs corresponding best to the species of the log to be debarked and to the debarking conditions. It can thus be ensured that the feeding rollers damage the surface of the log to be debarked as little as possible without that the feeding and centring operations suffer.

Figure 2:
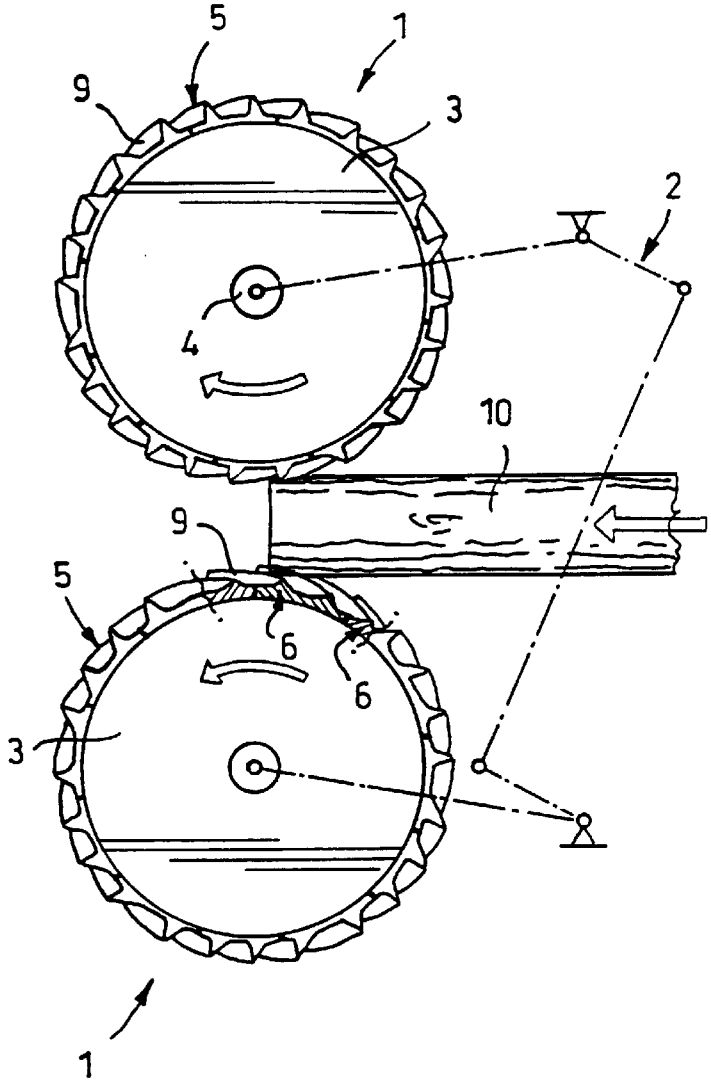

In the following, the invention will be described in greater detail with reference to the accompanying drawings, in which FIGS. 1 and 2 are schematic views of a feeding device of a debarking machine in the feeding direction of the log and in a direction perpendicular to the feeding direction of the log, respectively, FIGS. 3, 4 and 5 are a top view, end view, and sectional view along line V—V in FIG. 3, respectively, of a single separate rib element on a larger scale, and FIGS. 6 and 7 are sectional views along lines VI—VI and VII—VII, respectively, in FIG. 3.

FIGS. 1 and 2 illustrate a feeding device of a debarking machine. The feeding device comprises two superimposed feeding rollers 1 rotatably mounted in bearings on a base (not shown). The feeding rollers 1 are connected to each other by a lever mechanism 2 in such a manner that the movement of one feeding roller forces the other feeding roller to move in the opposite direction.

Each feeding roller comprises a drum-like body 3 having supporting shafts 4, and a rib formation 5 supported on the body. According to the invention, the rib formation is provided by a set of separate rib elements 6 secured one after the other to the cylindrical outer surface of the body of the feeding roller by screws 7 so that the set of rib elements extends around the entire circumference of the body. Each element is plate-like and has an inner support surface 8 in the form of a cylinder sector and two ribs 9 positioned on the outer surface.

Seen from the end of a rib element, the ribs of the element form a V-shaped channel for guiding a log 10 to be debarked to the middle of the feeding roller. The rib elements are mounted on the circumference of the feeding roller in such a number that, when rotating, the rib formation closely resembles the outer shape of a double-cone cylinder.

The centring effect of the rib element for centring a log in its lateral direction is caused by the rib angle d, which is determined according to the range of the diameters of the logs to be debarked with the debarking machine to ensure that the gripping ridges 9*a* make contact with all logs of various diameters.

The log feeding force is adjusted by changing the rib angles b and c. If angle b is made smaller and angle c greater, the ribs grip the surface of the log more tightly, which increases the feeding force. Changing the rib angles b and c also affects the counteracting force which prevents the rotation of the log together with the debarking blades.

The feeding forces and anti-rotation forces are provided for different purposes by changing the angles b and c according to the debarking conditions and the tree species to be debarked in separate sets of rib elements.

The depth to which the ribs penetrate the surface of a log is an essential factor in view of the use of the debarked log. The penetration depth depends essentially on the strength of the wood to be treated and on the conditions: e.g. frozen wood is essentially harder than unfrozen wood. The penetration of a rib into the surface of a log can be changed by using a combination of different rib angles a and b and sharpnesses of the ridge r.

The invention enables the manufacture of separate sets of rib elements, the sets having different cone angles, gripping angles and/or ridge angles, shape and height of the ribs, etc. It is thus possible to provide the same roller body with different sets of rib elements, as desired, to meet the requirements in each particular case by simply changing the set of rib elements. Since the sets of rib elements are easy to change (e.g. a screw joint), the penetration of a rib into the wood can be adjusted according to the tree species and the prevailing conditions by using rib elements with different angles a and b and different sharpness of the ridge r.

The drawings and the description relating thereto are intended merely to illustrate the idea of the invention. In its details, the feeding roller of the invention may vary within the scope of the appended claims. The term "drum-like" refers herein mainly to a part with a cylindrical, polygonal or similar outer surface suitable for mounting rib elements one after the other. A rib element can, if necessary, comprise even more than two ribs, depending on the manufacturing technique. Instead of a screw joint, it is also possible to secure the set of rib elements in some other way, e.g. by a welded joint when the feeding roller is made for a specific use under constant conditions. The same standard body can thus be used for manufacturing feeding rollers with different properties.

I claim:

1. A feeding roller for a log feeding device of a debarking machine, said feeding roller comprising a substantially drum-like body and a rib formation consisting of ribs positioned at intervals on the circumference of said body, the ribs are provided in removable rib elements secured to said body and mounted one after the other around the circumference of said body wherein said rib elements provided for said body of said feeding roller are removably securable for replacement by different rib elements for different tree species and debarking conditions.

2. A feeding roller according to claim 1, wherein each said rib element comprises at least two ribs positioned one after the other in the circumferential direction of said body.

3. A feeding roller according to claim 1 wherein each said rib element is plate-like and comprises a support surface in the form of a cylinder sector mountable against said body and at least one rib positioned on the opposite side of the support surface.

4. A feeding roller according to claim 3, wherein each said rib element including said ribs belonging to the same set of rib elements being identical in shape.

5. A feeding roller according to claim 1, wherein the cone angle, gripping angle and ridge angle of said ribs vary from one set of rib elements to another.

6. A feeding roller system, comprising:

a substantially drum-like body;

a plurality of sets of ribs, each of said rib sets having a structure that is different than that of the other rib sets; and means for mounting one of the sets of ribs about the circumference of the body.

* * * * *